US008051817B2

(12) United States Patent
Yamaguchi

(10) Patent No.: US 8,051,817 B2
(45) Date of Patent: Nov. 8, 2011

(54) VARIABLE VALVE MECHANISM

(75) Inventor: Koki Yamaguchi, Nishio (JP)

(73) Assignee: Otics Corporation, Nishio-Shi, Aichi-Ken (JP)

( * ) Notice: Subject to any disclaimer, the term of this patent is extended or adjusted under 35 U.S.C. 154(b) by 289 days.

(21) Appl. No.: 12/458,774

(22) Filed: Jul. 22, 2009

(65) Prior Publication Data

US 2010/0024753 A1 Feb. 4, 2010

(30) Foreign Application Priority Data

Aug. 1, 2008 (JP) ..... 2008-200043

(51) Int. Cl.
*F01L 1/34* (2006.01)

(52) U.S. Cl. ..... 123/90.16

(58) Field of Classification Search ..... 123/90.15, 123/90.16, 90.39
See application file for complete search history.

(56) References Cited

U.S. PATENT DOCUMENTS

| | | | | |
|---|---|---|---|---|
| 6,938,596 | B2 * | 9/2005 | Naumann | 123/90.4 |
| 7,311,073 | B1 | 12/2007 | Kim et al. | |
| 7,451,729 | B2 * | 11/2008 | Sugiura et al. | 123/90.16 |
| 2001/0052329 | A1 | 12/2001 | Himsel | |
| 2004/0074457 | A1 * | 4/2004 | Maas et al. | 123/90.16 |
| 2005/0103292 | A1 | 5/2005 | Naumann | |
| 2007/0095311 | A1 * | 5/2007 | Tateno et al. | 123/90.16 |
| 2009/0151669 | A1 * | 6/2009 | Kim et al. | 123/90.12 |

FOREIGN PATENT DOCUMENTS

| | | | |
|---|---|---|---|
| EP | 1 710 402 | A1 | 10/2006 |
| EP | 1 873 362 | A1 | 1/2008 |
| JP | 11-324625 | A | 11/1999 |

OTHER PUBLICATIONS

European Search Report dated Apr. 16, 2010.

* cited by examiner

*Primary Examiner* — Thomas Denion
*Assistant Examiner* — Daniel Bernstein
(74) *Attorney, Agent, or Firm* — McGinn IP Law Group, PLLC

(57) ABSTRACT

The present invention provides a variable valve mechanism which includes a camshaft having a drive cam, a rocker shaft provided parallel to the camshaft, and a variable mechanism that is provided on the rocker shaft and interposed between the drive cam and a valve, and that changes an opening/closing amount of the valve. The variable mechanism includes a main arm that engages with the drive cam, a cam arm that has a cam surface pressing the valve, a control cam that is provided on the rocker shaft, and has an outer peripheral surface whose distance from a shaft center of the rocker shaft varies gradually, and a displacement member whose distance from the shaft center is changed by turning of the control cam. A relative phase between the main arm and the cam arm is displaced as the distance between the displacement member and the shaft center changes.

6 Claims, 6 Drawing Sheets

VARIABLE VALVE MECHANISM

TECHNICAL FIELD

The present invention relates to a variable valve mechanism that controls valve characteristics according to the operating state of an internal combustion engine.

BACKGROUND ART

Conventionally, a variable valve mechanism 100 of Patent Literature 1 shown in FIG. 6 is known as a variable valve mechanism that controls the lift amount, the working angle, and the opening/closing timing of a valve according to the operating state of an internal combustion engine.

This variable valve mechanism 100 includes a camshaft 101 which is rotated by a crankshaft (not shown) of the internal combustion engine, and a valve-operating member 103 that opens and closes a valve 102. A drive cam 104 is fixed on the camshaft 101 so as to be turnable integrally with the camshaft 101. Moreover, a swing cam 106, which includes a cam surface 105 engaging with the valve-operating member 103, is supported on the camshaft 101 so as to be turnable relative to the camshaft 101.

A variable link 109 is swingably supported on a control shaft 107, which is parallel to the camshaft 101, through an eccentric cam 108. One end of the variable link 109 is connected to the drive cam 104 by a ring-shaped link 110, and the other end of the variable link 109 is connected to the swing cam 106 by a rod-shaped link 111. The variable valve mechanism 100 transmits the power of the drive cam 104 to the swing cam 106 through the three links 109, 110, 111, and changes the swing angle of the variable link 109 by the eccentric cam 108, thereby changing the lift amount and the working angle of the valve 102 according to the operating state of the internal combustion engine.

CITATION LIST

Patent Literature

Patent Literature 1: Japanese Patent Application Publication No. JP-A-H11-324625

SUMMARY OF INVENTION

Technical Problem

In the variable valve mechanism 100, however, the control shaft 107 is provided above the camshaft 101 (in a direction away from a cylinder). Thus, the variable valve mechanism 100 has a large overall height, resulting in a large overall height of a cylinder head.

It is therefore an object of the present invention to provide a variable valve mechanism in which the overall height of a cylinder head does not increase.

Solution to Problem

In order to achieve the above object, a variable valve mechanism of the present invention includes: a camshaft including a drive cam; a rocker shaft provided parallel to the camshaft; and a variable mechanism that is provided on the rocker shaft and interposed between the drive cam and a valve, and that changes an opening/closing amount of the valve. The variable mechanism includes a main arm that is swingably supported by the rocker shaft, and engages with the drive cam, a cam arm that is swingably supported by the rocker shaft, and has a cam surface pressing the valve, a control cam that is provided on the rocker shaft, and has an outer peripheral surface whose distance from a shaft center of the rocker shaft varies gradually, and a displacement member that is connected to the main arm and the cam arm through a connection member, and is in contact with the control cam. A distance between the displacement member and the shaft center is changed by turning of the control cam. A relative phase between the main arm and the cam arm is displaced as the distance between the displacement member and the shaft center changes.

The form of the displacement member is not specifically limited. However, the displacement member is preferably a roller which is rotatably shaft-attached to the connection member, because this reduces the friction with the control cam.

The form of the main arm is not specifically limited. However, in the main arm, a portion engaging with the drive cam is preferably a roller that is turnably shaft-attached, because this reduces the friction with the drive cam.

It is preferable to interpose a valve-operating member between the cam arm and the valve, because the valve-operating member can automatically adjust valve clearance.

Although the form of the valve-operating member is not specifically limited, examples of the valve-operating member include a rocker arm which swings about a base end as a fulcrum, a valve lifter capable of linearly moving in an axial direction of the valve.

Advantageous Effects of Invention

The present invention can provide a variable valve mechanism in which the overall height of a cylinder head does not increase.

DESCRIPTION OF EMBODIMENTS

A variable valve mechanism of the present invention includes: a camshaft including a drive cam; a rocker shaft provided parallel to the camshaft; and a variable mechanism that is provided on the rocker shaft and interposed between the drive cam and a valve, and that changes an opening/closing amount of the valve. The variable mechanism includes: a main arm that is swingably supported by the rocker shaft, and engages with the drive cam; a cam arm that is swingably supported by the rocker shaft, and has a cam surface pressing the valve; a control cam that is provided on the rocker shaft, and has an outer peripheral surface whose distance from a shaft center of the rocker shaft varies gradually; and a displacement member that is connected to the main arm and the cam arm through a connection member, rotatably shaft-attached to the connection member, and is in contact with the control cam. A distance between the displacement member and the shaft center is changed by turning of the control cam. A relative phase between the main arm and the cam arm is displaced as the distance between the displacement member and the shaft center changes.

EXAMPLES

Figure 1:
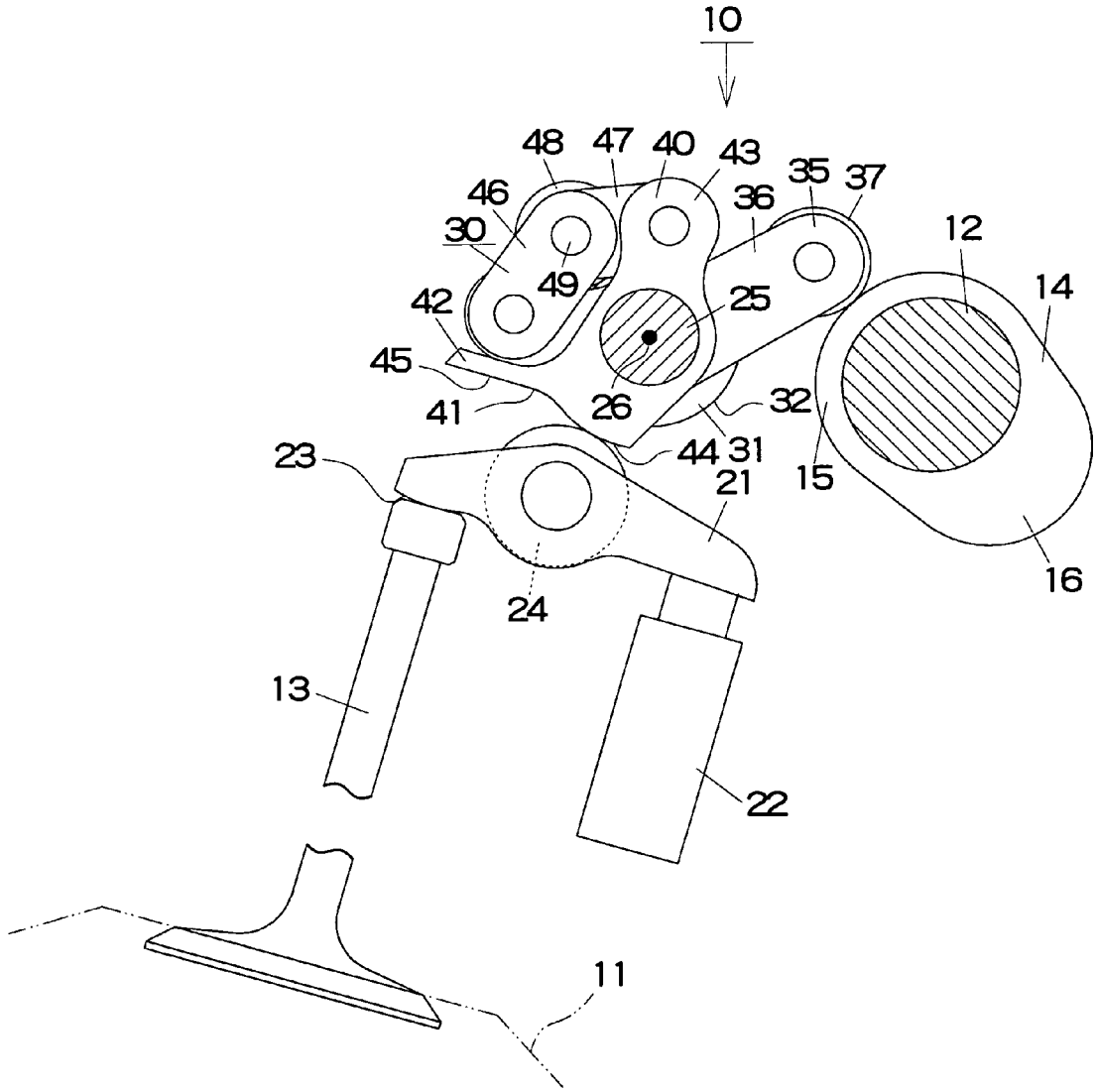
FIG. 1 is a general view of a variable valve mechanism of the present invention.
Figure 2B:
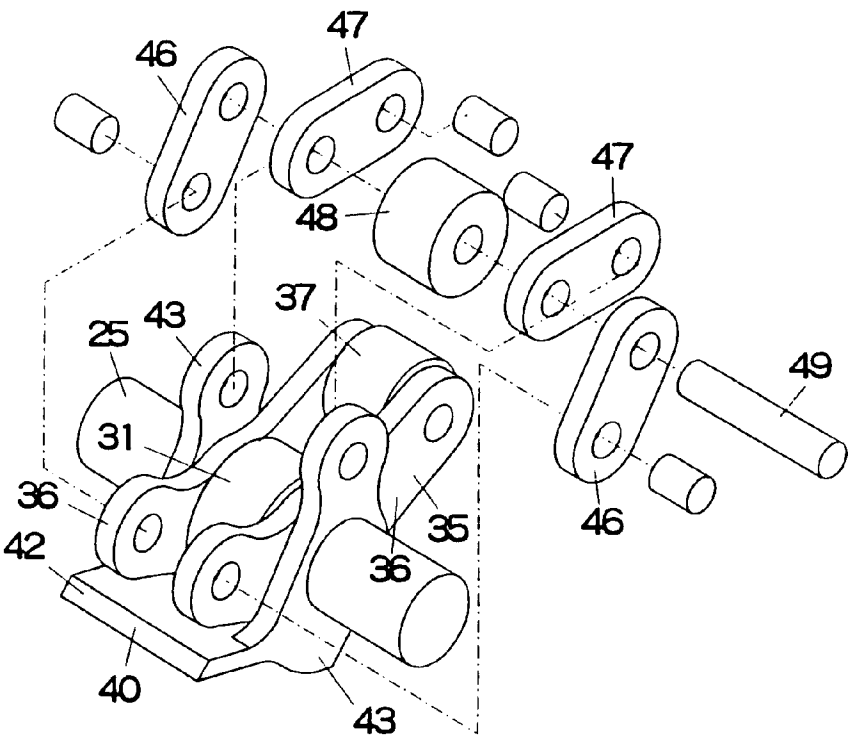
FIGS. 2A and 2B are exploded perspective views of a variable mechanism of the variable valve mechanism.
Figure 2A:
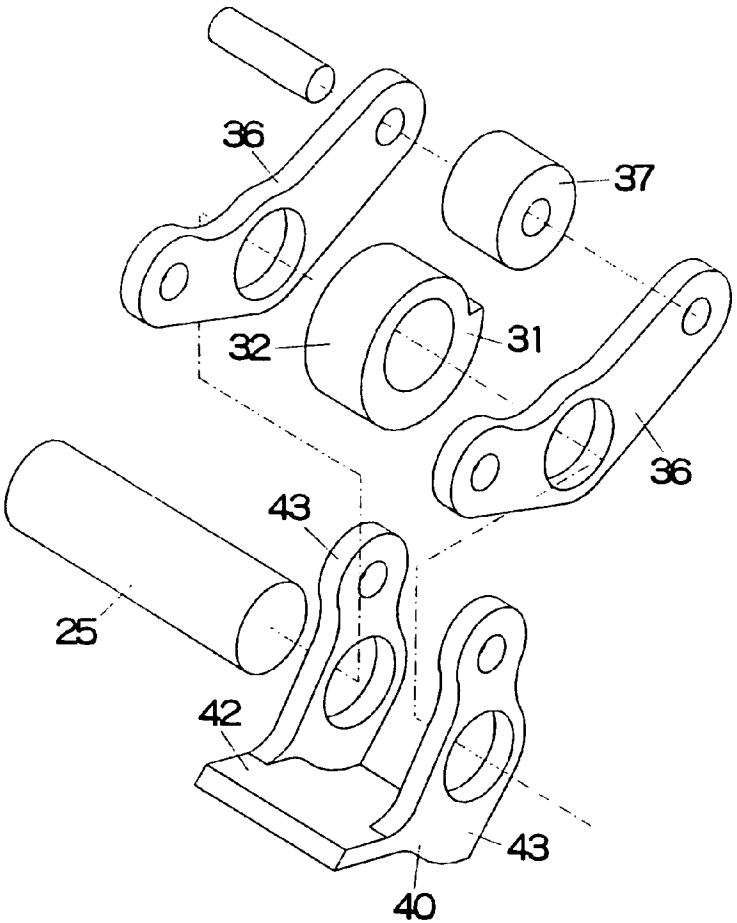

An example of the present invention will be described below based on FIGS. 1 through 5B. A variable valve mechanism 10 of this example is used in an intake system of an automobile gasoline engine. However, the same variable valve mechanism may be used in an exhaust system of the gasoline engine. As shown in FIG. 1, a camshaft 12 of the variable valve mechanism 10 is supported by a housing (not shown) located above a cylinder head 11 (the term "above" indicates a direction away from a cylinder; the same applies to the similar terms in the following description), and is rotated by a crankshaft of the engine. A drive cam 14 is fixed on the camshaft 12 at a position corresponding to a valve 13. A constant radius portion 15 and a nose portion 16 are formed in the drive cam 14.

A rocker arm 21 that automatically adjusts valve clearance is supported under the camshaft 12 (the term "under" indicates a direction toward the cylinder; the same applies to the similar terms in the following description) by a pivot 22 located on the base-end side, so as to be swingable up and down. The rocker arm 21 is biased upward by a spring (not shown) provided on the valve 13. A pressing portion 23 that presses the valve 13 is provided at a tip of the rocker arm 21, and a base roller 24 is supported in an intermediate portion of the rocker arm 21.

A rocker shaft 25 is provided above the rocker arm 21 so as to be parallel to the camshaft 12. An actuator (not shown), which is operationally controlled according to the operating state of the engine, and turns the rocker shaft 25, is connected to one end of the rocker shaft 25.

A variable mechanism 30 is provided on the rocker shaft 25. The variable mechanism 30 has a control cam 31, a main arm 35, a cam arm 40, and a displacement roller 48. The control cam 31 is fixed to the rocker shaft 25. The main arm 35 is swingably supported by the rocker shaft 25 at positions on both sides of the control cam 31 in an axial direction of the rocker shaft 25. The cam arm 40 is swingably supported by the rocker shaft 25 at positions on both sides of the main arm 35 in the axial direction of the rocker shaft 25. The displacement roller 48 is connected to the main arm 35 through a pair of first connection members 46, and is connected to the cam arm 40 through a pair of second connection members 47.

The control cam 31 has an outer peripheral surface (cam surface) 32 whose distance from a shaft center 26 of the rocker shaft 25 varies gradually. The displacement roller 48 is in contact with the outer peripheral surface 32. The control cam 31 is turned by turning of the rocker shaft 25.

The main arm 35 is formed by two plate-shaped arm plates 36 and a cam roller 37. The arm plates 36 are provided at the positions on both sides of the control cam 31, respectively. The cam roller 37 is rotatably shaft-attached to respective one ends of the arm plates 36, and engages with the drive cam 14. The rocker shaft 25 is inserted through respective intermediate portions of the arm plates 36, and the cam roller 37 is shaft-attached to the respective one ends of the arm plates 36, so that the arm plates 36 integrally swing about the rocker shaft 25. The pair of plate-shaped first connection members 46 are swingably shaft-attached to the other ends of the arm plates 36.

The cam arm 40 is formed by a cam surface portion 42 and a pair of arm piece portions 43. The cam surface portion 42 has a cam surface 41 which is in slide contact with the base roller 24, and which presses the valve 13 through the rocker arm 21. The pair of arm piece portions 43 are provided parallel with each other, and respectively protrude from both ends of the back side of the cam surface portion 42. The rocker shaft 25 is inserted through respective intermediate portions of the arm piece portions 43. The pair of plate-shaped second connection members 47 are swingably shaft-attached to respective tips of the arm piece portions 43, respectively. The cam surface 41 is formed by a base surface portion 44 having an arc shape about the shaft center 26, and a planar lift surface portion 45 continuous from the base surface portion 44.

The displacement roller 48 is provided between the pair of second connection members 47. A displacement shaft 49 connecting the pair of first connection members 46 and the pair of second connection members 47 is inserted through the displacement roller 48 so that the displacement roller 48 becomes rotatable. Moreover, the displacement roller 48 is biased by a lost motion mechanism (not shown) or the like in a direction toward the shaft center 26, so as to be constantly in contact with the control cam 31.

The variable mechanism 30 structured as described above is formed as a pantograph-like link mechanism by the main arm 35, the cam arm 40, the first connection member 46, and the second connection member 47.

Functions of the variable valve mechanism 10 will be described below according to FIGS. 3A through 5B.

Figure 3A:
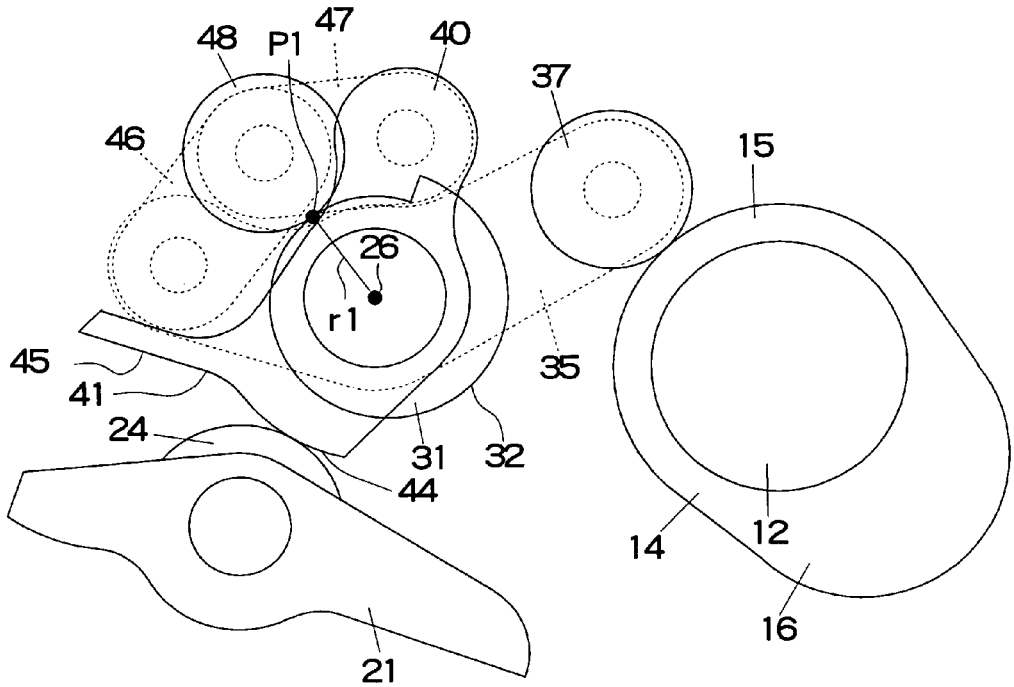
FIGS. 3A and 3B are illustrations of displacement of a cam arm which is caused by turning of a control cam of the variable valve mechanism.
Figure 3B:
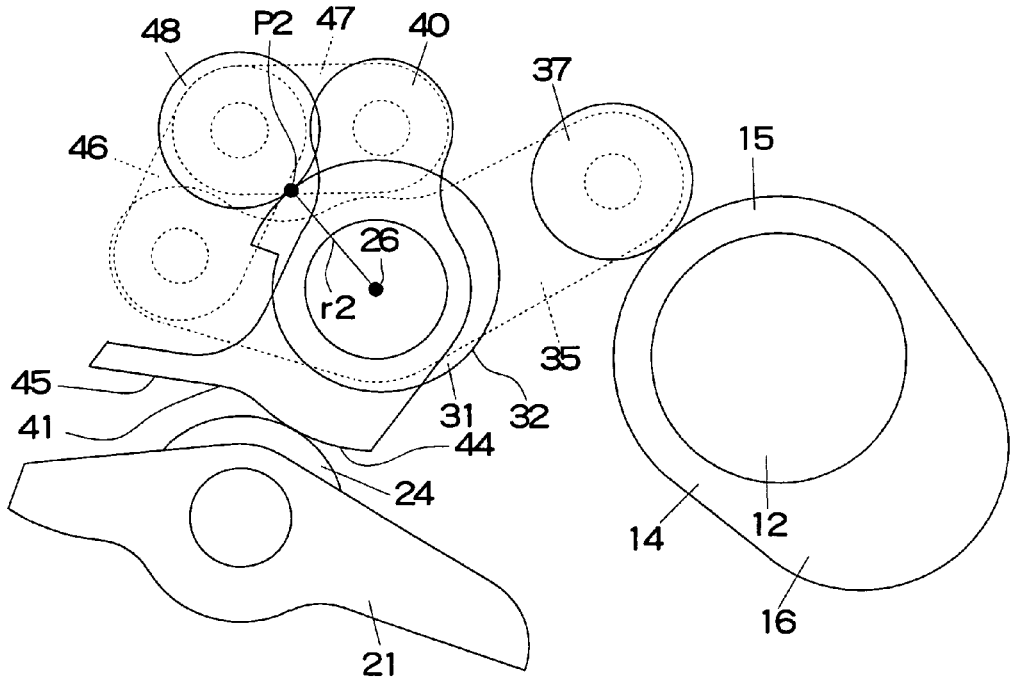

FIGS. 3A and 3B show displacement of a relative phase between the main arm 35 and the cam arm 40, which is caused by turning of the control cam 31 when the cam roller 37 engages with the constant radius portion 15. More specifically, FIG. 3A shows a state when the displacement roller 48 contacts a point P1 on the outer peripheral surface 32 of the control cam 31, and FIG. 3B shows a state when the displacement roller 48 contacts a point P2 on the outer peripheral surface 32 of the control cam 31. Note that the arm plate 36, the first connection member 46, and the second connection member 47 are shown by broken line.

Since the point P2 is located farther away from the shaft center 26 than the point P1 is, a distance r2 between the point P2 and the shaft center 26 is larger than a distance r1 between the point P1 and the shaft center 26. Moreover, r1 and r2 also indicate the distance between the displacement roller 48 and the shaft center 26. Thus, when the control cam 31 turns, and the displacement roller 48, which has been in contact with the control cam 31 at the point P1, is brought into contact with the control cam 31 at the point P2, the distance between the displacement roller 48 and the shaft center 26 increases. On the contrary, when the displacement roller 48, which has been in contact with the control cam 31 at the point P2, is brought into contact with the control cam 31 at the point P1, the distance between the displacement roller 48 and the shaft center 26 decreases.

As the distance between the displacement roller 48 and the shaft center 26 changes, a relative phase of the cam arm 40 with respect to the main arm 35 is displaced, and the position where the cam arm 40 is in slide contact with the base roller 24 is displaced. More specifically, when the displacement roller 48 is in contact with the point P2 on the outer peripheral surface 32 of the control cam 31 (FIG. 3B), the position in the base surface portion 44 of the cam arm 40 at which the cam arm 40 is in slide contact with the base roller 24 is located more toward the lift surface portion 45 than when the displacement roller 48 is in contact with the point P1 on the outer peripheral surface 32 of the control cam 31 (FIG. 3A). In other words, as the distance between the displacement roller 48 and the shaft center 26 increases, the position in the base surface portion 44 at which the cam arm 40 is in slide contact with the base roller 24 is located closer to the lift surface portion 45. On the contrary, as the distance between the displacement roller 48 and the shaft center 26 decreases, the position in the base surface portion 44 at which the cam arm 40 is in slide contact with the base roller 24 is located farther away from the lift surface portion 45.

Figures 4A, 4B:
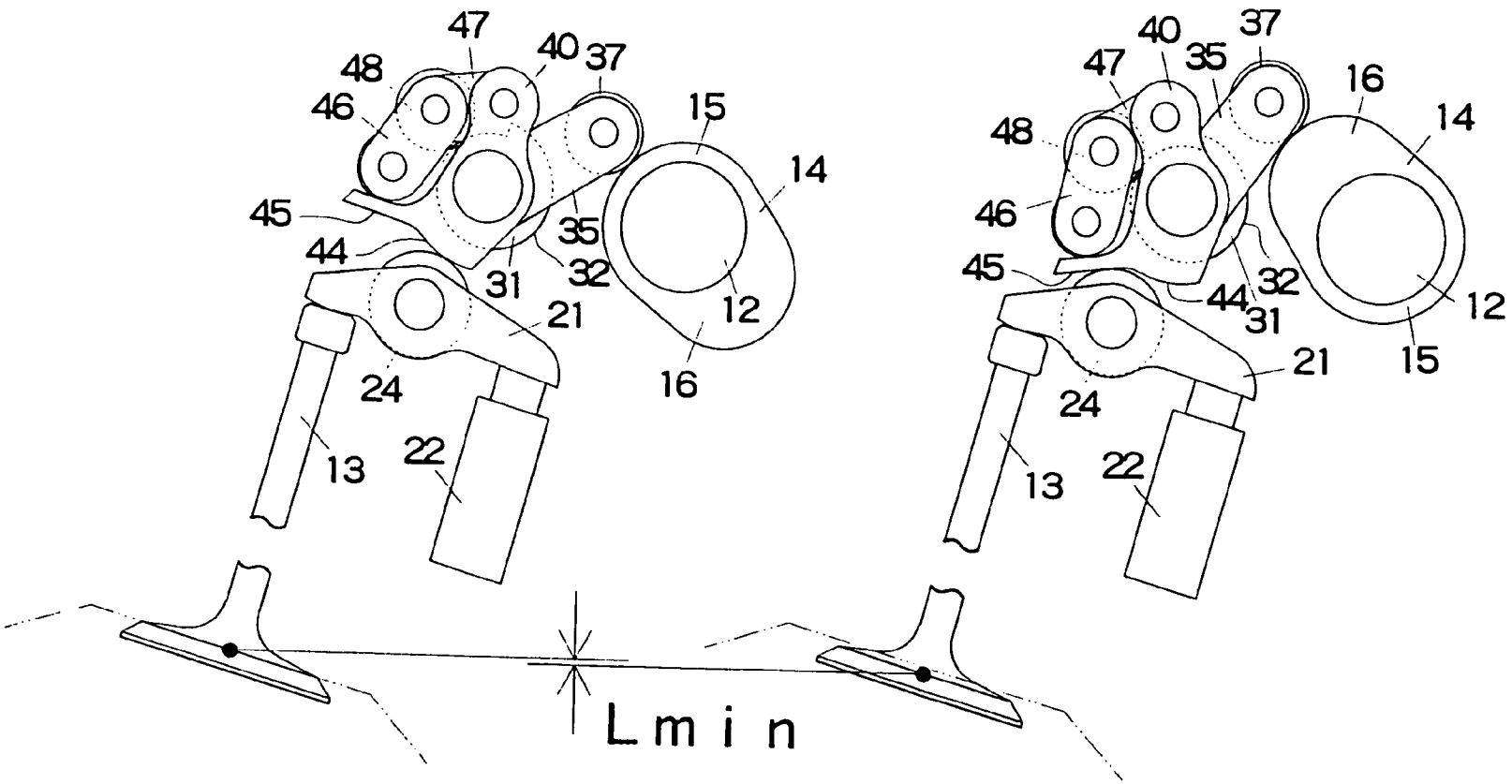
FIGS. 4A and 4B are illustrations when the valve lift amount in the variable valve mechanism is minimized.

FIGS. 4A and 4B show functions of the variable valve mechanism 10 when the valve 13 is opened and closed with a minimum lift amount. As shown in FIG. 4A, the displacement roller 48 is in contact with the control cam 31 at such a position on the outer peripheral surface 32 that the distance between the outer peripheral surface 32 and the shaft center 26 becomes the smallest, and the distance between the displacement roller 48 and the shaft center 26 is the smallest. Moreover, the cam roller 37 engages with the constant radius portion 15, and the base roller 24 is in contact with the cam arm 40 at the position in the base surface portion 44, which is located farther away from the lift surface portion 45. While the base roller 24 is in slide contact with the base surface portion 44, no force that presses down the valve 13 against the biasing force of the spring is generated in the rocker arm 21, and the valve 13 is held at the closed position.

As shown in FIG. 4B, when the camshaft 12 rotates and the cam roller 37 engages with the nose portion 16, the main arm 35 swings. As the main arm 35 swings, the displacement roller 48 connected to the main arm 35 through the first connection member 46 moves on the outer peripheral surface 32. As the displacement roller 48 moves on the outer peripheral surface 32, the cam arm 40 connected to the displacement roller 48 through the second connection member 47 swings, and the lift surface portion 45 is brought into slide contact with the base roller 24. Since the base roller 24 slightly slides on the lift surface portion 45, the cam arm 40 slightly presses down the rocker arm 21. Then, the rocker arm 21 slightly presses down the valve 13 against the biasing force of the spring, and the valve 13 is opened with a minimum lift amount (Lmin).

Figures 5A, 5B:
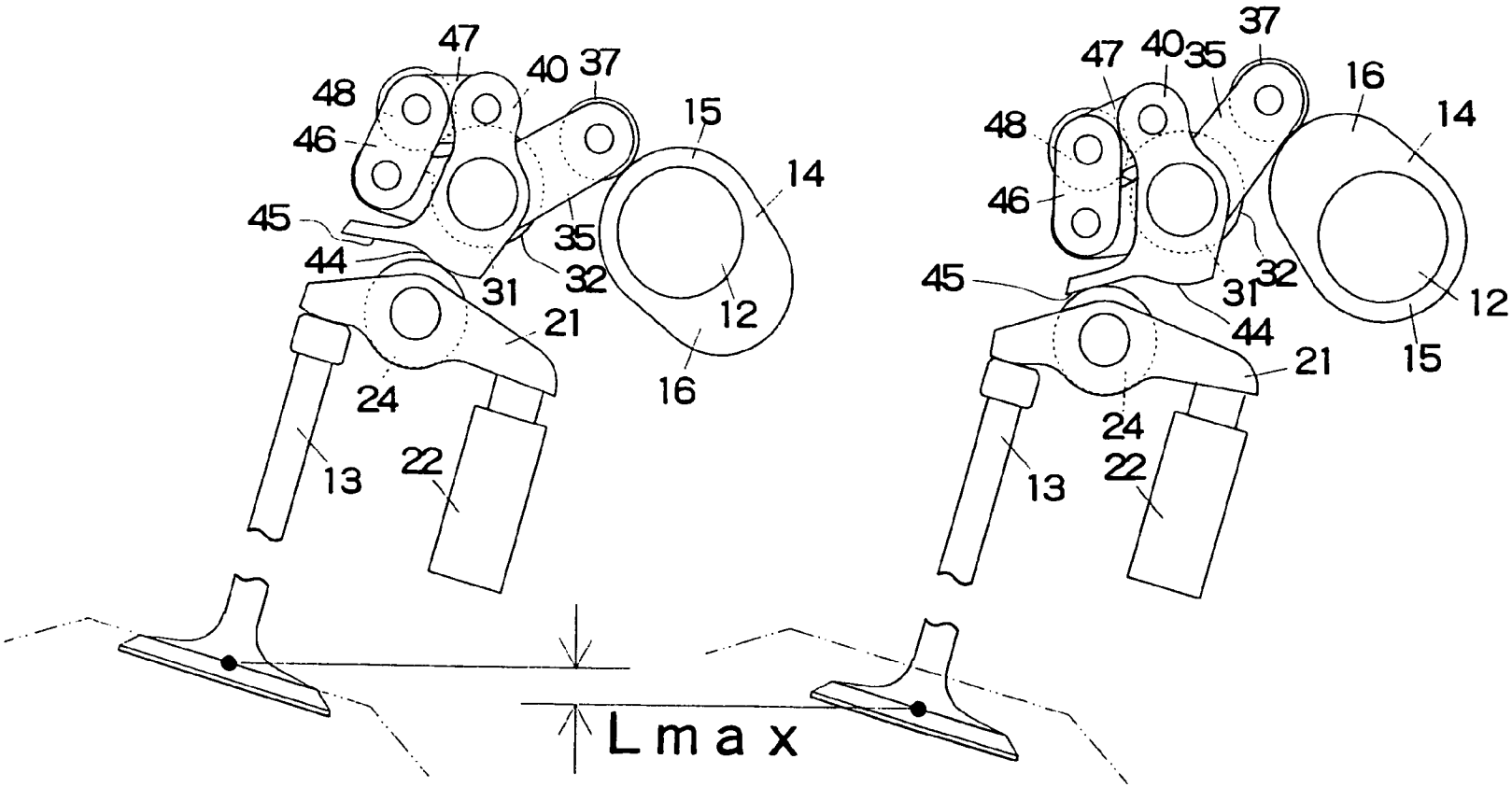
FIGS. 5A and 5B are illustrations when the valve lift amount in the variable valve mechanism is maximized.
Figure 6:
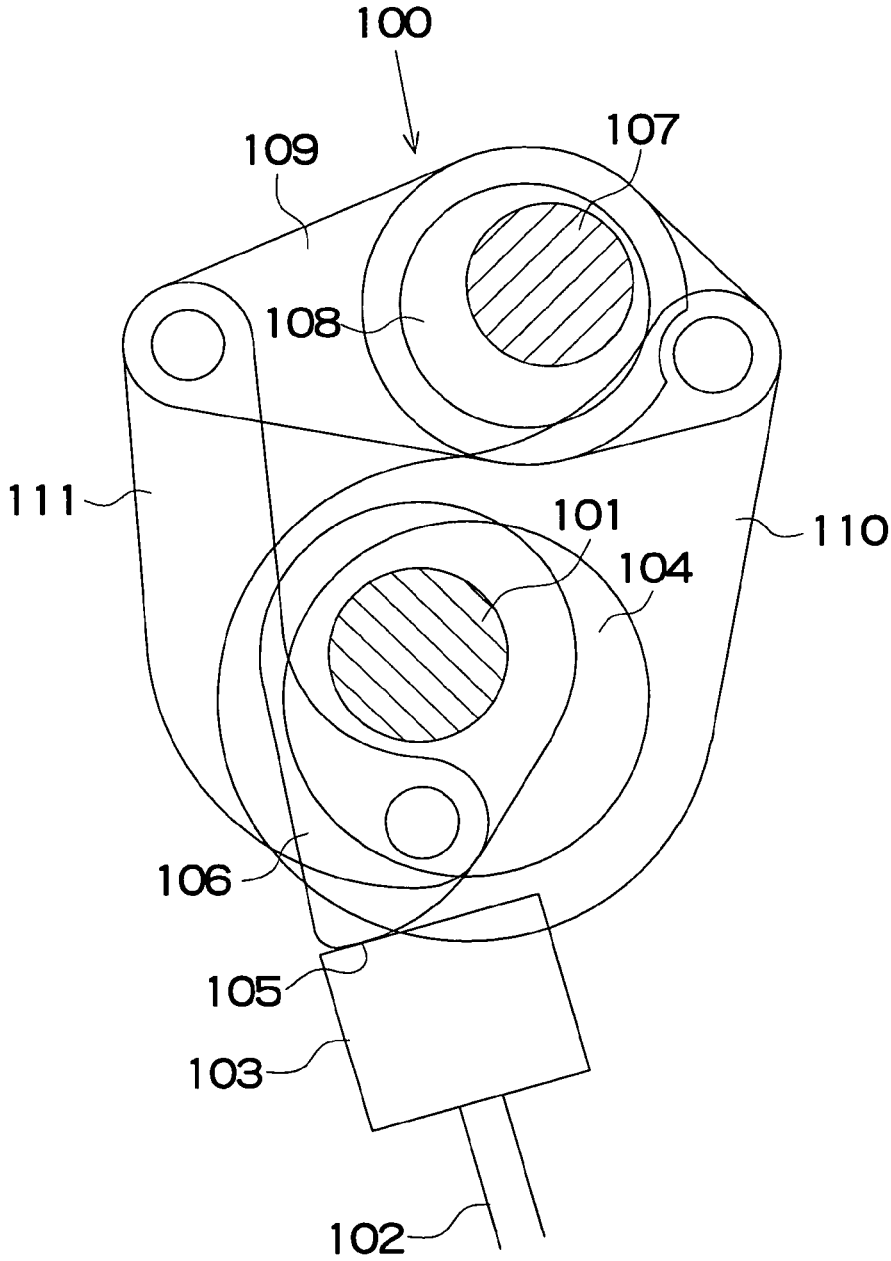
FIG. 6 is a general view of a variable valve mechanism in related art.

FIGS. 5A and 5B show functions of the variable valve mechanism 10 when the valve 13 is opened and closed with a maximum lift amount. As shown in FIG. 5A, the displacement roller 48 is in contact with the control cam 31 at such a position on the outer peripheral surface 32 that the distance between the outer peripheral surface 32 and the shaft center 26 becomes the largest, and the distance between the displacement roller 48 and the shaft center 26 is the largest. Moreover, the cam roller 37 engages with the constant radius portion 15, and the base roller 24 is in contact with the cam arm 40 at the position in the base surface portion 44, which is located closer to the lift surface portion 45. While the base roller 24 is in slide contact with the base surface portion 44, no force that presses down the valve 13 against the biasing force of the spring is generated in the rocker arm 21, and the valve 13 is held at the closed position.

As shown in FIG. 5B, when the camshaft 12 rotates and the cam roller 37 engages with the nose portion 16, the main arm 35 swings. As the main arm 35 swings, the displacement roller 48 connected to the main arm 35 through the first connection member 46 moves on the outer peripheral surface 32. As the displacement roller 48 moves on the outer peripheral surface 32, the cam arm 40 connected to the displacement roller 48 through the second connection member 47 swings, and the lift surface portion 45 is brought into slide contact with the base roller 24. Since the base roller 24 slides a long distance on the lift surface portion 45, the cam arm 40 presses down the rocker arm 21 to a large degree. Then, the rocker arm 21 presses down the valve 13 to a large degree against the biasing force of the spring, and the valve 13 is opened with a maximum lift amount (Lmax).

The following effects (a) and (b) are obtained according to this example.

(a) Since the control cam 31 is provided on the rocker shaft 25, the overall height of the cylinder head can be reduced as compared to other continuously variable valve mechanisms of a rotation control system (e.g., the variable valve mechanism 100).

(b) Since the variable valve mechanism is provided for each valve 13 (completed for each valve), the variable valve mechanism can be mounted on an internal combustion engine without being affected by peripheral parts such as plug tubes and injectors, which are provided in the middle above a cylinder.

Note that the present invention is not limited to the above example, and can be embodied without departing from the scope of the invention.

The invention claimed is:

1. A variable valve mechanism (10), comprising:

a camshaft (12) including a drive cam (14);

a rocker shaft (25) provided parallel to the camshaft (12); and a variable mechanism (30) that is provided on the rocker shaft (25) and interposed between the drive cam (14) and a valve (13), and that changes an opening/closing amount of the valve (13), wherein the variable mechanism (30) includes a main arm (35) that is swingably supported by the rocker shaft (25), and engages with the drive cam (14), a cam arm (40) that is swingably supported by the rocker shaft (25), and has a cam surface (41) pressing the valve (13), a control cam (31) that is provided on the rocker shaft (25), and has an outer peripheral surface (32) whose distance from a shaft center (26) of the rocker shaft (25) varies gradually, and a displacement member (48) that is connected to the main arm (35) and the cam arm (40) through a connection member (46, 47) and is in contact with the control cam (31), wherein a distance between the displacement member (48) and the shaft center (26) is changed by turning of the control cam (31), and wherein a relative phase between the main arm (35) and the cam arm (40) is displaced as the distance between the displacement member (48) and the shaft center (26) changes.

2. The variable valve mechanism according to claim 1, wherein the main arm (35) comprises an arm plate (36) in which the rocker shaft (25) is inserted through an intermediate portion thereof, and a cam roller (37) which is rotatably shaft-attached to one end of the arm plate (36) and engages with the drive cam (14).

3. The variable valve mechanism according to claim 1, wherein the cam arm (40) comprises a cam surface portion (42) having the cam surface (41), and an arm piece portion (43) that protrudes from a back side of the cam surface portion (42), and wherein the rocker shaft (25) is inserted through an intermediate portion of the arm piece portion (43).

4. The variable valve mechanism according to claim 1, wherein the cam surface (41) comprises a base surface portion (44) having an arc shape about the shaft center (26), and a planar lift surface portion (45) continuous from the base surface portion (44).

5. The variable valve mechanism according to claim 1, wherein the variable mechanism (30) is formed as a pantograph-like link mechanism by the main arm (35), the cam arm (40), and the connection members (46, 47).

6. The variable valve mechanism according to claim 1, wherein the displacement member (48) is a roller (48) which is rotatably shaft-attached to the connection member (46, 47).

* * * * *